US010987600B2

(12) United States Patent
Galfano et al.

(10) Patent No.: US 10,987,600 B2
(45) Date of Patent: Apr. 27, 2021

(54) CLOTHING FOR A TWO-DIMENSIONAL DOLL

(76) Inventors: Melissa B. Galfano, Forest Hills, NY (US); Thomas Galfano, Forest Hills, NY (US)

( * ) Notice: Subject to any disclaimer, the term of this patent is extended or adjusted under 35 U.S.C. 154(b) by 417 days.

(21) Appl. No.: 13/342,638

(22) Filed: Jan. 3, 2012

(65) Prior Publication Data

US 2013/0171908 A1 Jul. 4, 2013

(51) Int. Cl.

| | |
|---|---|
| ***A63H 3/08*** | (2006.01) |
| ***A63H 3/52*** | (2006.01) |
| ***A63H 3/10*** | (2006.01) |
| ***A63H 33/16*** | (2006.01) |

(52) U.S. Cl.

CPC ..... *A63H 3/08* (2013.01); *A63H 3/10* (2013.01); *A63H 3/52* (2013.01); *A63H 33/16* (2013.01)

(58) Field of Classification Search

CPC ... A63H 3/08; A63H 3/10; A63H 3/52; A63H 33/16

USPC ..... 446/98, 387; 2/5, 80

See application file for complete search history.

(56) References Cited

U.S. PATENT DOCUMENTS

| | | | | |
|---|---|---|---|---|
| 381,391 | A | 4/1888 | Law | |
| 537,791 | A * | 4/1895 | Trufant | 446/98 |
| 554,410 | A * | 2/1896 | Bailey | 446/387 |
| 565,994 | A | 8/1896 | King | |
| 1,231,145 | A * | 6/1917 | Ferguson | 446/98 |
| 1,261,360 | A * | 4/1918 | Carson | 2/74 |
| 1,305,071 | A * | 5/1919 | Davis | A63H 3/08 446/98 |
| 1,309,487 | A * | 7/1919 | Reeser et al. | 2/75 |
| 1,372,189 | A * | 3/1921 | Pollock | 2/75 |
| 1,601,393 | A * | 9/1926 | Nandor | A63H 3/08 446/98 |
| 2,189,550 | A | 2/1940 | Higgins | |
| 2,203,128 | A * | 6/1940 | Cairo | 446/98 |
| 2,237,897 | A | 4/1941 | Vos | |
| 2,642,697 | A * | 6/1953 | Haskell | A63H 3/52 446/98 |
| 2,683,955 | A * | 7/1954 | Olson | A63H 3/08 446/387 |
| 3,296,737 | A | 1/1967 | Doyle | |
| 3,311,923 | A * | 4/1967 | Ausman | 2/74 |
| 3,316,669 | A * | 5/1967 | Nachbar | 40/620 |
| 3,380,074 | A * | 4/1968 | Tokutaro | 2/93 |
| 4,382,303 | A * | 5/1983 | Lunt | 2/114 |
| 4,547,907 | A * | 10/1985 | Netsky | 2/114 |
| 4,745,634 | A * | 5/1988 | Douez | 2/69 |
| 4,925,429 | A | 5/1990 | Kaulfuss et al. | |
| 4,975,984 | A * | 12/1990 | Sting | 2/114 |
| 5,535,449 | A * | 7/1996 | Dickey | 2/69 |
| 5,607,339 | A | 3/1997 | Kramer | |

(Continued)

*Primary Examiner* — Eugene L Kim
*Assistant Examiner* — Alyssa M Hylinski
(74) *Attorney, Agent, or Firm* — The Plus IP Firm; Jason Barton; Derek Fahey

(57) ABSTRACT

The presently disclosed technology is directed towards two-dimensional clothing for a doll that has a portal or passage way for a head and neck of a doll to pass through and which further has shoulder straps that rest on at least one shoulder of the doll. In addition, such a device has a fold line at a line of symmetry between a front side and back side of the clothing which is used to fold the clothing or to adjust the clothing based on the size or fashion style of a doll.

7 Claims, 11 Drawing Sheets

(56) References Cited

U.S. PATENT DOCUMENTS

| | | | | |
|---|---|---|---|---|
| 6,049,909 | A * | 4/2000 | Anderson | A41D 11/00 2/111 |
| 6,475,054 | B1 | 11/2002 | Liu | |
| 6,536,048 | B2 * | 3/2003 | Frye | A41B 13/103 2/49.1 |
| 2006/0277654 | A1 * | 12/2006 | Turner | 2/114 |

* cited by examiner

CLOTHING FOR A TWO-DIMENSIONAL DOLL

BACKGROUND OF THE DISCLOSED TECHNOLOGY

A doll resembles a person, and is generally used as a toy for children. Dolls were used as toys by the Ancient Greeks and Romans, and such dolls also had clothes. In our era, there are many people who collect dolls of all types, divided into many categories depending on the material used to craft the doll, the style of the doll, its origin, etc. Since dolls are made to look like humans, they are also used for teaching purposes. For example, one could use a doll to demonstrate to a child how to put on clothes.

Since, dolls are produced to resemble people, they are usually made as realistic as possible, especially in connection with the accessories and clothes they wear. There is an endless variety of accessories and clothes for different kinds of dolls, depending on what type of a person the doll is intended to resemble. Towards that end, having removable clothes for dolls is important, because it completes the image of the doll and makes it more human-like, since people wear different types of clothes for different events or functions.

Some prior art designs have devised different ways of attaching clothes to dolls, such as the design disclosed in U.S. Pat. No. 6,475,054 to Kuo-Ching Liu, which talks about a three-dimensional built-up toy with doll, clothes, and a base, where a device for coupling clothing to the doll is used to attach the clothing thereto.

Further, another prior art design, such as the one disclosed in U.S. Pat. No. 4,925,429 to Kaulfuss et al. shows a planar flexible material toy with two "generally similar and opposable sides" which extend to form a connective member. The sides are flexed to connect free ends, though the lengths of the sides are unequal.

Still further, another design, as disclosed in U.S. Pat. No. 5,607,339 to Kramer talks about a bath toy formed from flexible sheets of plastic. Starting at column 1, line 51, this reference describes how a child may dress a doll with clothing. This is done by mounting a body to a wall, and then placing clothing on top of the body.

What is further needed in the art is a way to clothe two-dimensional dolls which is more lifelike and realistic than that of the predecessors.

SUMMARY OF THE DISCLOSED TECHNOLOGY

An object of the disclosed technology is to dress a two-dimensional doll (a flat doll, such as a paper doll known in the art) with clothes made up of paper-like or paper material in such a way as to make a doll look dressed.

In an embodiment of the disclosed technology, a device has clothing made of paper for a two-dimensional or paper doll. The doll may be of any size, such as between 10 inches and 7 feet (life size). Hereinafter, "two-dimensional doll" refers to a paper doll or the equivalent, such as a doll having a front and back side and thin sides, the sides having a width less than ¼ of an inch. The clothing has a depiction of a front side of clothing and a depiction of a back side of clothing created from a first side of a piece of paper. Each side of the clothing is created from a different piece or sheet of paper. Further, the clothing has a fold line which demarcates symmetry between the front side depiction and the back side depiction. In addition, the clothing has a portal extending from a point of the fold line closest to the neck of the doll, where such a portal is adapted for placement on at least one shoulder of the doll through the use of shoulder straps.

In the above embodiment, the portal may be further adapted for placement on two shoulders of the two-dimensional doll. In addition, the opposite side of depictions of the front side of clothing may be on a second side of the paper. Even further, the opposite side of depictions of the back side of the clothing may be on a second side of the paper.

Further, in the above embodiment, the fold line may be folded where the back and front side of the clothing meet by applying glue at points located under each shoulder strap but above the folded fold line. In addition, the fold line may be folded where the back and front side meet by placing a tape at points located under each shoulder strap but above the fold line.

Still further, in order to make the clothes fit the doll, shoulder straps connected to the fold line may be folded to fit the requirements of a doll's size. In addition, shoulder straps connected to the fold line may be folded when a doll's style of clothing requires it, in order to match the style of the doll. Further, in the above embodiment of the technology, shoulder straps connected to the fold line may remain extended all the way when a doll's size requires this, in order to make the clothing longer or cover a greater area of the doll. In addition, the shoulder straps connected to the fold line may remain extended all the way when a doll's style of clothing requires this, in order to match with the doll's fashion style.

In another embodiment of the disclosed technology, a device has a kit containing a two-dimensional doll and clothing adapted for the doll. Further, the clothing has a front and a back portion forming a unitary piece of clothing, where a majority of each front and back portion corresponds to the other portion thereof. Further, the clothing has at least one line of symmetry between the front and the back portion. Still further, the clothing has a portal extending from a point of the line of symmetry closest to the neck of the doll, where the portal is adapted for placement on at least one shoulder of the doll though the use of a shoulder strap or straps.

Further, in the above embodiment, there may be two lines of symmetry that exist between the front portion and the back portion of the unitary piece of clothing. In addition, each portion of the clothing may be made up of a separate piece of paper or paper-like material. Further, the portal may be adapted for placement on two shoulders of the doll.

In addition, in the same above embodiment of the disclosed technology, the back and the front sides of the clothing may meet by a method where tape is placed on top of at least one line of symmetry connecting both sides. Further, the back and the front sides of the clothing may meet in a way such that tape is placed on top of the two lines of symmetry connecting both sides.

Further, in the above embodiment, the shoulder straps connected to the line of symmetry may be folded when a doll's style of clothing requires such an action in order to match the doll's fashion style. In addition, the shoulder straps connected to the line of symmetry may remain extended all the way when a doll's size requires the straps to extend all the way in order for the clothing to fit the doll's size or to cover a greater area of the doll. Still further, the shoulder straps connected to the line of symmetry may remain extended all the way when a doll's style of clothing requires this.

In another embodiment of the disclosed technology, a device has a two-dimensional doll and clothing where the clothing has front and back portions forming a unitary piece, and where a majority of the front and back portion corresponds to the other portion thereof. Further, the clothing has at least one line of symmetry between the front and back portions which separates the two portions, and such line of symmetry has at least one fold line. In addition, when the line of symmetry is folded at the fold line, the clothing rests on the neck of the doll, since the clothing has an opening for placement or passage there-through of the head of the doll.

DETAILED DESCRIPTION OF EMBODIMENTS OF THE DISCLOSED TECHNOLOGY

The presently disclosed technology is directed towards two-dimensional clothing for a doll that has a portal or passage way for a head and neck of a doll to pass through, and which further has shoulder straps that rest on at least one shoulder of the doll. In addition, such a device has a fold line at a line of symmetry between a front side and back side of the clothing which is used to fold the clothing or to adjust the clothing based on size or fashion style of a doll. As also explained in the summary, when referring to a "two-dimensional doll" and "two-dimensional clothing" this is defined as a paper doll, paper clothing, or the equivalent, such as a doll having a front and back side and thin sides, the width of the shoulder strap being, for example, less than ¼ inch and the width of of the shoulder/doll being scalable, depending on the size of the doll. As explained below, while the material is generally paper, other materials which are equivalent also fit within the definition of a "two dimensional" doll or clothing.

Both the front and back sides of the clothing, in embodiments of the disclosed technology, are produced from a first side of a paper. Paper is defined as a thin material used for writing on, drawing on, printing on, painting on, or packaging, and further is a material that is flexible and can be cut with an average pair of scissors found in the art. The paper is folded over at a line of symmetry, such that the first side of the paper is both on the front and back side. The inside of the clothing, herein also referred to as the opposite side of the front side or opposite side of the back side of the clothing, corresponds to the back side or second side of the same paper.

Embodiments of the disclosed technology will become clearer in view of the following description of the figures.

Figure 1:
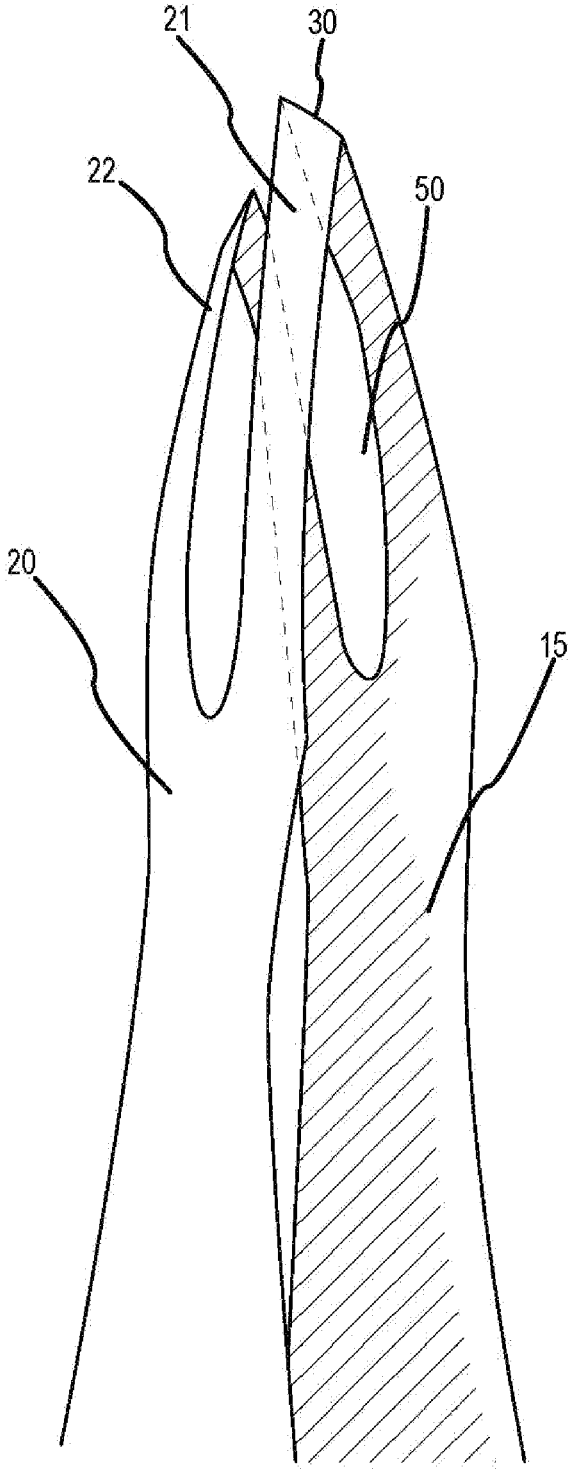
FIG. 1 shows a perspective view of clothing for a doll in embodiments of the disclosed technology.

FIG. 1 shows a perspective view of clothing for a doll in embodiments of the disclosed technology. FIG. 1 shows a fold line 30 which is defined as a line of symmetry between back side 20 and front side 10 of clothing or defined alternatively, in asymmetric embodiments, as a line where two sides of the clothing meet. In addition, a portal 50 is shown which is defined as an opening extending through fold line 30 and into at least part of a front side and back side of the clothing. The portal 50 is adapted for placement on at least one shoulder of a doll. Shoulder straps 11/12 (shown in FIG. 3) and straps 21/22 (shown in FIG. 1) are used to rest the clothing on at least one shoulder of the doll. A head of a doll may pass through the portal 50 when placing the clothing on the doll.

Figure 11:
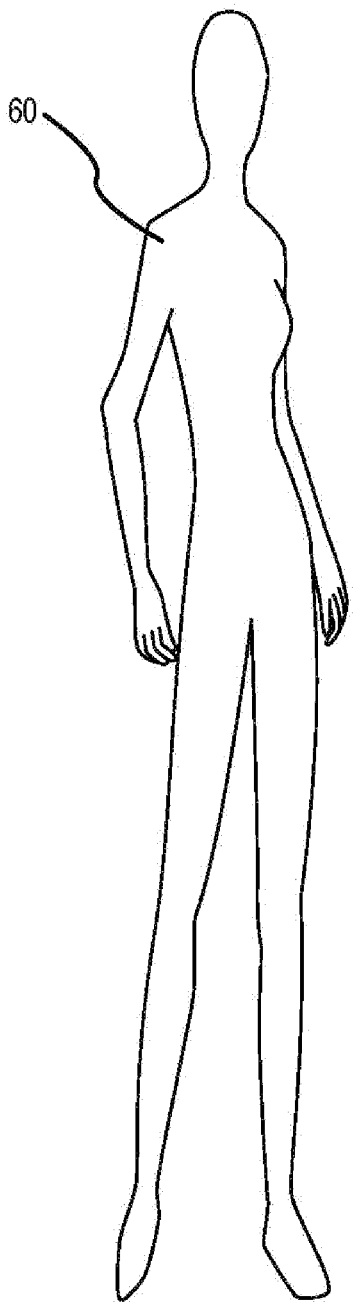
FIG. 11 shows a plan view of a two dimensional doll.

In addition, FIGS. 1 (and 3) show straps 21/22 and 11/12 which are defined as an area of clothing extending from the fold line 30 all the way to the most distant point (e.g., lowest edge of the clothing) of the portal 50 on each corresponding side of clothing, where each strap is a part of a side of the clothing, and where such side has at least one such strap resting on at least one shoulder of a doll 60 (shown in FIG. 11). The interior ports of the straps define portal 50, or at least a side thereof (in a one-strap embodiment). Back straps 21 and 22 are shown, and a back strap is defined as a strap that is a part of a back side 20 of clothing extending from fold line 30 to the furthest point of the portal 50 on the back side 20 of the clothing.

Still further, FIG. 1 shows a perspective view of two-dimensional clothing showing a back side 20 which is defined as an area of clothing extending from the fold line 30 all the way to the lowest edge of clothing covering the back side of a doll 60 (shown in FIG. 11). In addition, inside 15 of front side 10 is shown and is defined as the opposite side of the front side 10 of the clothing. The front side 10 of the clothing (shown in FIG. 3) is defined as the area of clothing extending from the fold line 30 located on the front side of a doll 60 all the way to the lowest point of clothing covering the front side of the doll 60.

Figure 2:
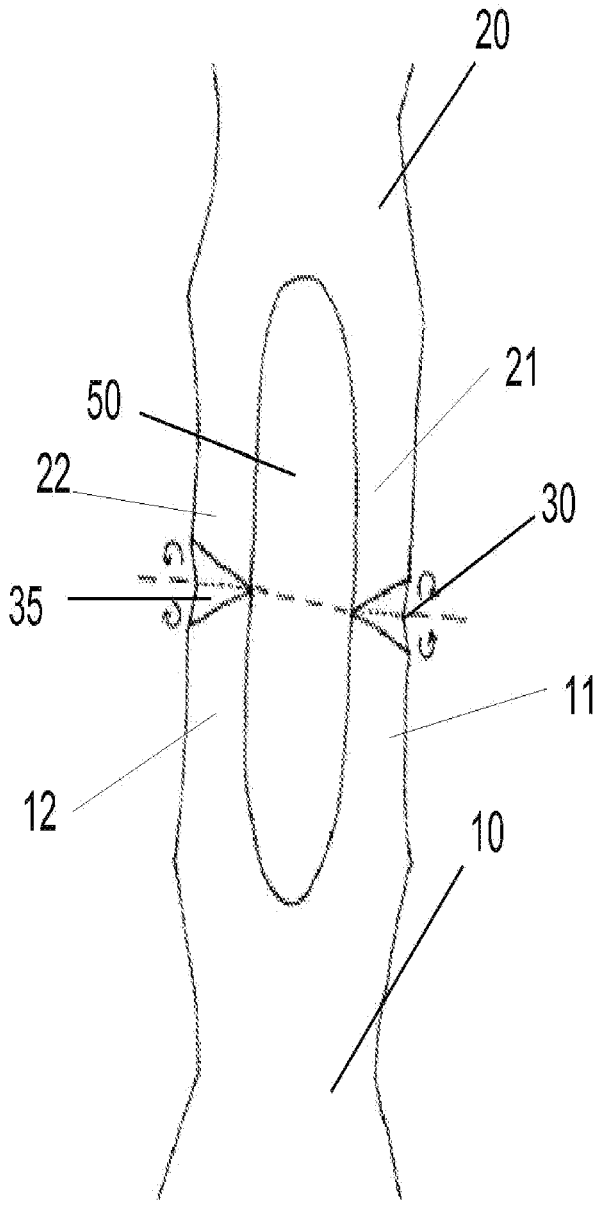
FIG. 2 shows a plan view of paper with fold lines used to create clothing for a doll in embodiments of the disclosed technology.

FIG. 2 shows a plan view of paper with fold lines used to create clothing for a doll in embodiments of the disclosed technology. FIG. 2 shows the fold line 30 and folded area 35 which is defined as an immediate area of the clothing that extends on each side of the folded line 30 which is a part of at least one combination of straps 11/21 or 12/22 resting on at least one shoulder. When folded, the folded areas (which extend downwards from the plane of the sheet on which FIG. 2 is shown, and then together) shortens the size of the clothing or decreases the area of the doll 60 covered by clothing. In this manner, the top of the shoulder straps may be shaped and stylized. Further, portal 50 is shown which allows for head and neck of the doll 60 to pass through. Furthermore, FIG. 2 shows front side 10 of clothing which covers the front side of the doll 60, and back side 20 of clothing which covers the back side of doll 60.

Figure 3:
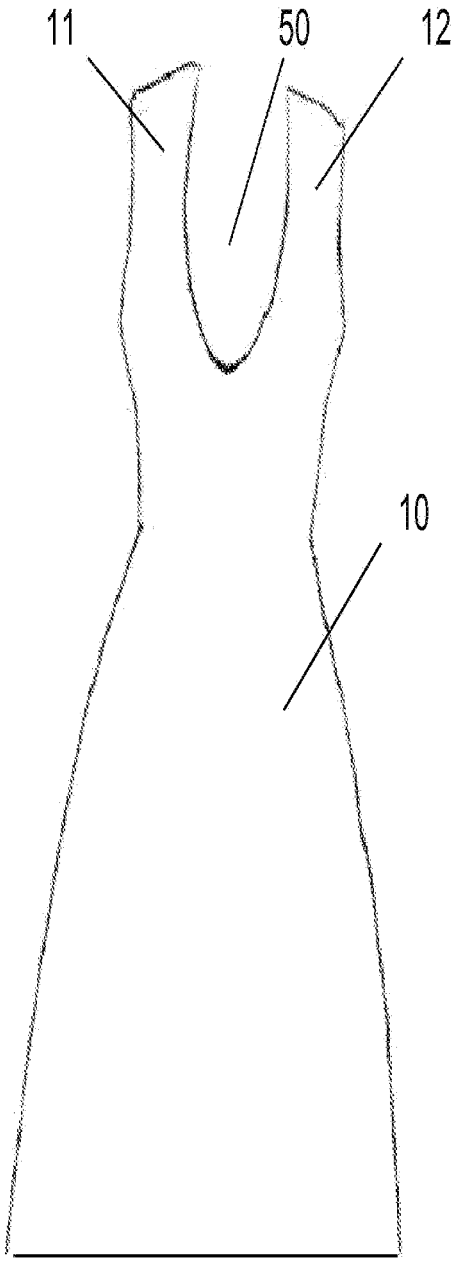
FIG. 3 shows a front view of clothing used for a doll in embodiments of the disclosed technology.

FIG. 3 shows a front view of clothing used for a doll in embodiments of the disclosed technology. FIG. 3 shows the front side 10 of clothing and front straps 11 and 12. A front strap 11 or 12 is defined as a strap that is part of the front side 10 of clothing extending from fold line 30 to the furthest point of the portal 50 on the front side 10 of the clothing. Again, portal 50 is an embodiment of the disclosed technology and is the opening area where the head and neck of a doll 60 pass through. In addition, front straps 11 and 12 are shown in this Figure, which are part of the front side 10 of clothing and which attach or are connected to other corresponding back straps 21 and 22 as shown in FIG. 2.

Figure 4:
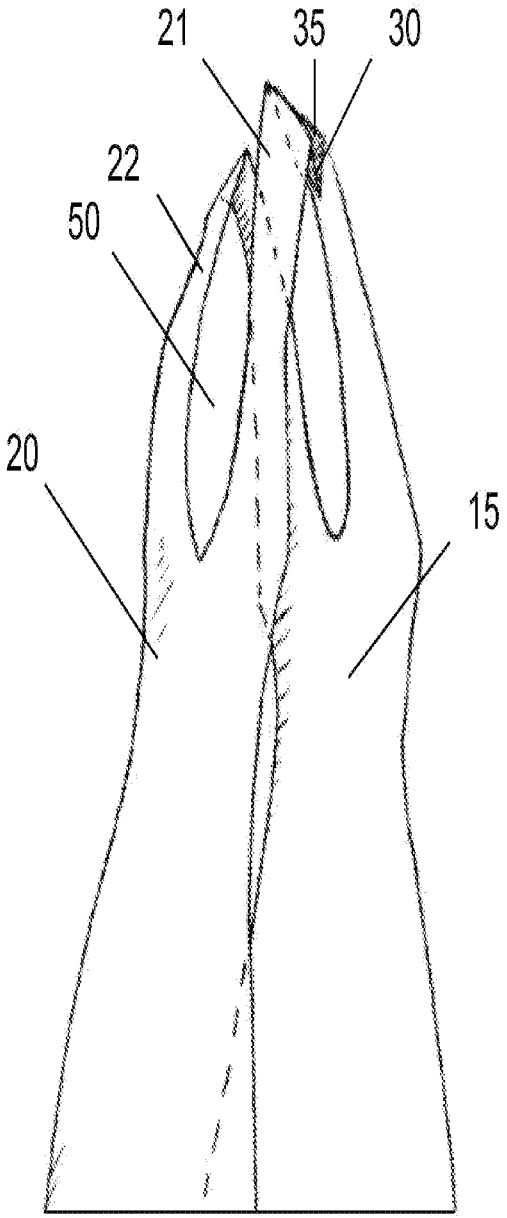
FIG. 4 shows another perspective view of clothing in embodiments of the disclosed technology.

FIG. 4 shows another perspective view of clothing of embodiments of the disclosed technology. In this figure, folds 35 are visible, and the resulting shaping of the top of the shoulder straps is shown. Further, this figure shows the fold line 30, portal 50, back side 20, back side straps 21/22 and the inside 15 of the front side 10 of clothing.

Figure 5:
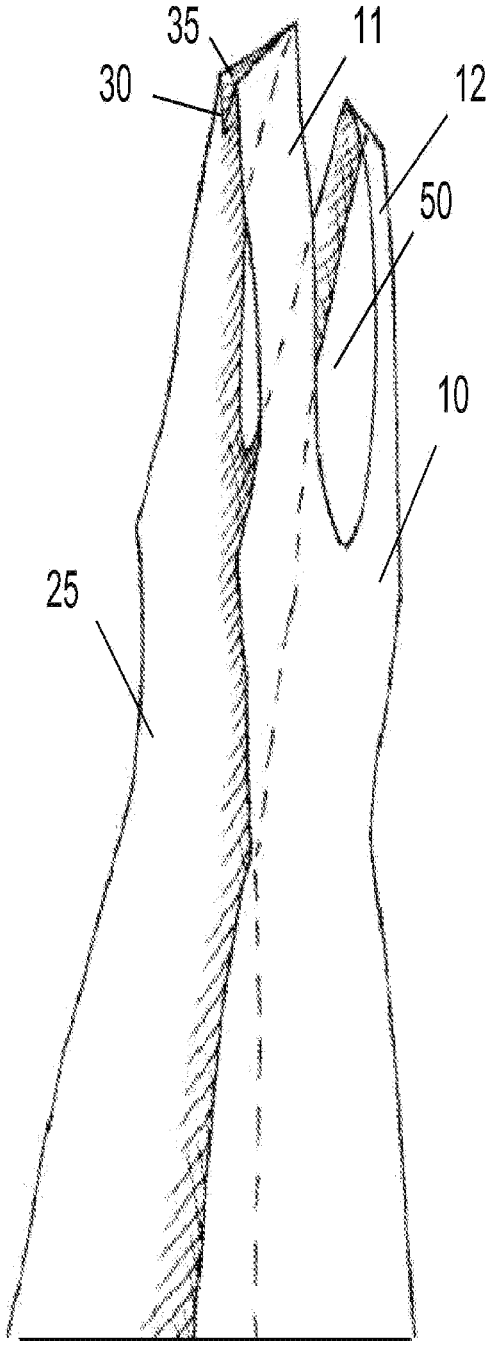
FIG. 5 shows a perspective view of clothing for a doll showing a front side, opposite side of back side of clothing, and a fold line at the top of the shoulder straps.

FIG. 5 shows a perspective view of clothing for a doll, showing a front side, opposite side of back side of clothing, and a fold line at the top of the shoulder straps. FIG. 5 shows a perspective view of embodiments of the disclosed technology rotated with respect to FIG. 4 so that the opposite, inside portion is visible. The fold line 30 and folded area 35 are shown, as well as the front straps 11/12, the front side 10 of clothing, the portal 50, and inside 25 of the back side 20 of clothing is shown, which is defined as the opposite side of the back side 20 of clothing.

Figure 6:
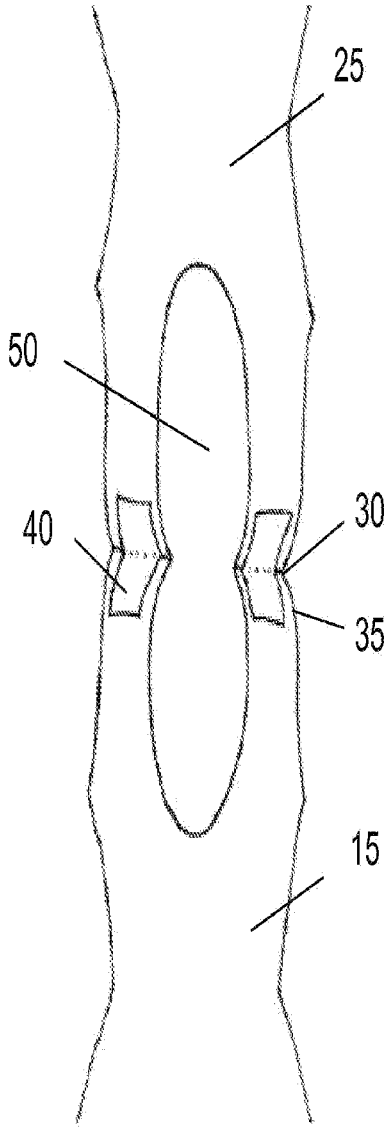
FIG. 6 shows a plan view of the underside of clothing for a doll, with tape placed on the fold line, in embodiments of the disclosed technology.

FIG. 6 shows a plan view of the underside of clothing for a doll, with tape placed on the fold line, in embodiments of the disclosed technology. FIG. 6 shows a top view of the inside of clothing of a doll and a tape 40 placed on points located on top of and above the fold line 30 and folded area 35 of embodiments of the disclosed technology. Tape 40 is defined as a sticky or glue material like paper or liquid glue that is able to hold together two structures that otherwise would move from each other during usage of the clothing on a doll. As shown in the Figure, tape 40 or glue is put on top of the fold line 30 and the folded area 35, when the folded area is folded in order to keep the folded area 35 and either side of the clothing together. Further, the Figure shows the portal 50, the inside 15 of the front side 10 of clothing, and the inside 25 of the back side 20 of clothing.

Figure 7:
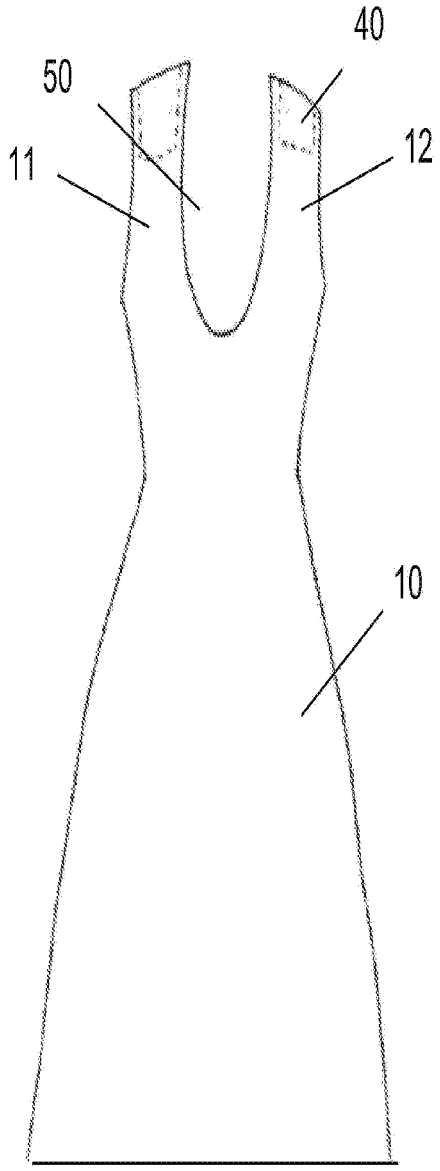
FIG. 7 shows a perspective view of clothing and the positioning of tape placed under the shoulder straps of the front side of clothing.

FIG. 7 shows a perspective view of clothing and the positioning of tape placed under the shoulder straps of the front side of clothing. FIG. 7 shows a front view of the front side 10 of the clothing and a tape 40 placed under the front shoulder straps 11/12 of the front side 10 of clothing. The figure also shows portal 50 used for passage through of the head and neck of the doll 60 (shown in FIG. 11).

Figure 8:
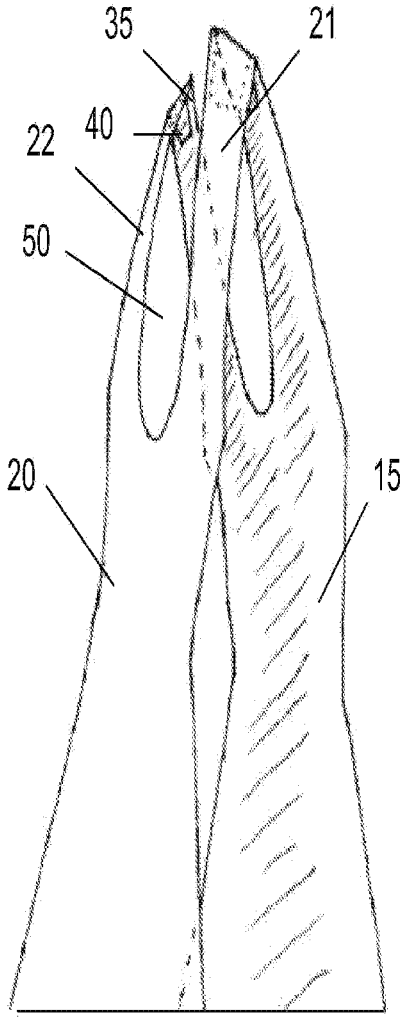
FIG. 8 shows a perspective view of the clothing of FIG. 7.

FIG. 8 shows a perspective view of the clothing of FIG. 7. FIG. 8 shows a perspective view of the back side 20 of clothing and the inside 15 of the front side 10 of the clothing, and a tape 40 placed on top of and covering the fold line 30 and folded area 35 of embodiments of the disclosed technology. Further, back straps 21/22 and portal 50 are shown.

Figure 9A:
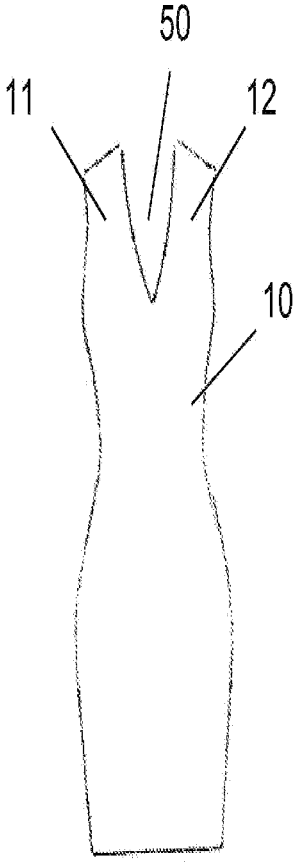
FIG. 9A shows a perspective view of a two-shoulder-strap dress in an embodiment of the disclosed technology.
Figure 9B:
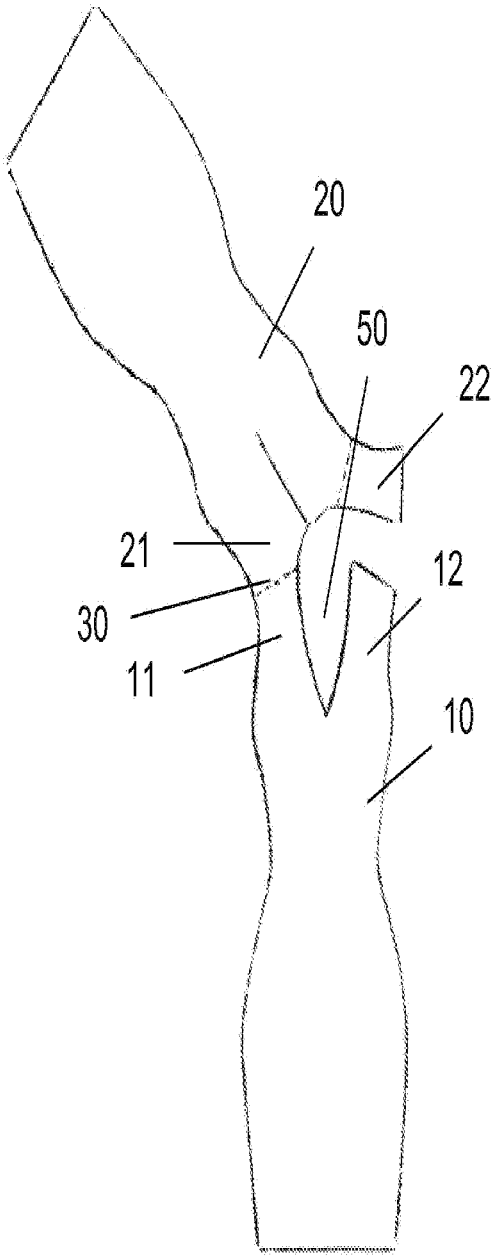
FIG. 9B shows a perspective view of an unfolded dress of FIG. 9A.

FIG. 9A shows a perspective view of a two shoulder strap dress in an embodiment of the disclosed technology. FIG. 9B shows a perspective view of an unfolded dress of FIG. 9A. The front side 10, front straps 11/12, and portal 50 are visible on the front side. Before the folding, in FIG. 9B, what is shown is on a single side of a paper. Front straps 11/12, back side 20 of clothing, and back straps 21/22, where back strap 22 is separated from front strap 12, are shown. Each strap corresponds to a strap of the other side of clothing. Further, fold line 30 and portal 50 are shown.

Figure 10A:
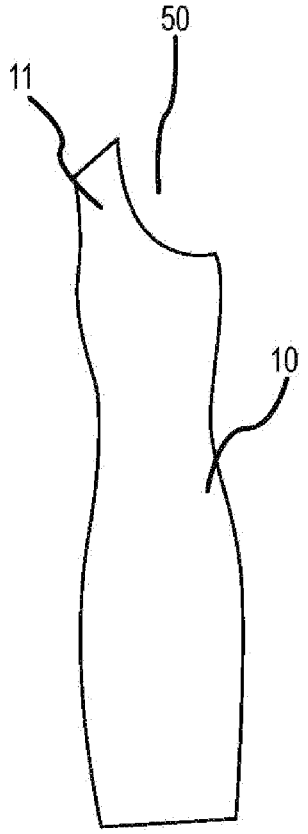
FIG. 10A shows a perspective view of a one-shoulder-strap dress in an embodiment of the disclosed technology.

FIG. 10A shows a perspective view of a one shoulder strap dress in an embodiment of the disclosed technology. Further, FIG. 10A shows a front view of the front side 10, front strap 11, and portal 50. Only front strap 11 and its corresponding strap 21 (shown in FIG. 10B) rest on a shoulder of a doll 60. However, such a combination is not limited only to front strap 11 and back strap 21 but could be accomplished by any combination of back and front straps, such as the combination of front strap 12 and back strap 22.

Figure 10B:
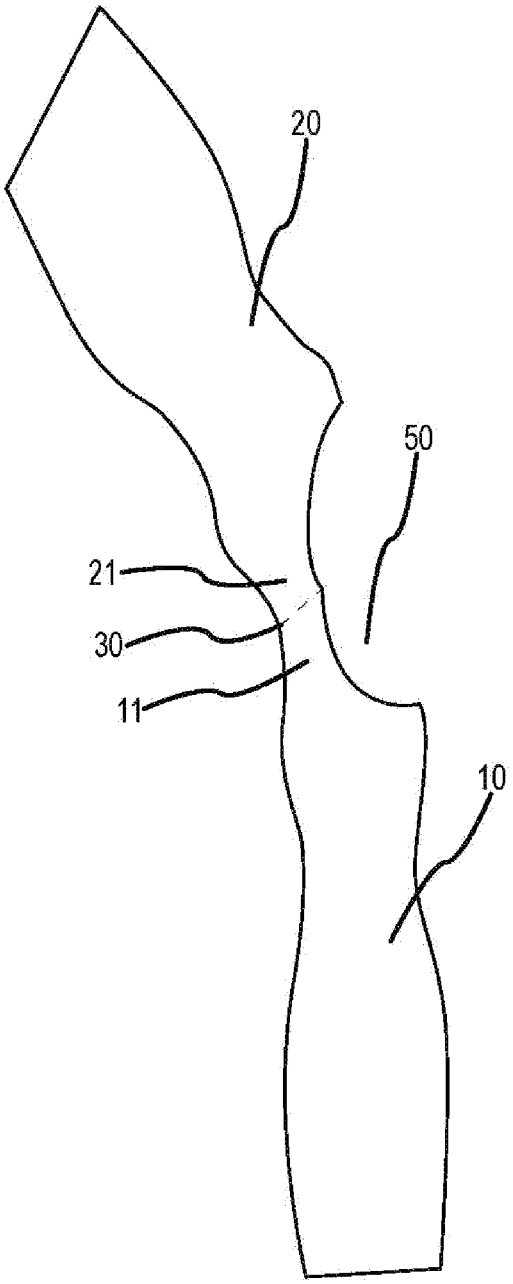
FIG. 10B shows a perspective view of an unfolded dress of FIG. 10A.

Further, FIG. 10B shows a perspective view of an unfolded dress of FIG. 10A. FIG. 10B shows a top view of the front side 10 of clothing, front strap 11, back side 20 of clothing, and back strap 21, where only front strap 11 and its corresponding strap 21 rest on a shoulder of a doll 60. However, as explained in FIG. 10A, such a combination is not limited only to front strap 11 and back strap 21 but could be accomplished by any combination of back and front straps, such as the combination of front strap 12 and back strap 22. Further, fold line 30 and portal 50 are also shown.

FIG. 11 shows a plan view of a two-dimensional doll. FIG. 11 shows a plan view of a two-dimensional doll 60 that wears clothing of embodiments of the disclosed technology. A doll 60 is defined as any toy resembling a person. Such a toy should be capable of wearing clothing of embodiments of the disclosed technology by putting the head of a toy or doll through the portal 50 of the clothing and let the portal 50 and a combination of shoulder straps 11 and 21 or 12 and 22 rest on at least one shoulder of the toy resembling a person. Also, the length of clothing can be adjusted based on the size or fashion style of the doll 60 by folding the folded area 35 which is immediately next to or adjacent to the fold line 30.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

We claim:

1. Two-dimensional clothing for a flat doll having shoulders, the two-dimensional clothing comprising:

a first side of a piece of paper and a second side of the piece of paper;

on the first side of the piece of paper, a depiction of a front side of clothing and a depiction of a back side of clothing;

a fold line at a line of symmetry between the depiction of the front side and the depiction of the back side of the two-dimensional clothing;

at least one shoulder strap with a front side portion and a back side portion separated by the fold line;

a folded area formed on the at least one shoulder strap, the folded area formed by two additional folds that intersect at the fold line on a side adjacent a portal of the two-dimensional clothing and extend outwardly away from the fold line to an opposite side of the at least one shoulder strap;

wherein one of glue and tape is placed on the second side of the piece of paper, covering the fold line and the folded area such that the two additional folds of the folded area remains folded;

wherein the portal extends from said line of symmetry, away from said line of symmetry in either direction; and, wherein the two-dimensional clothing is adapted for placement on the shoulders of said flat doll through use of the at least one shoulder strap extending from the front side of the two-dimensional clothing to the back side of the two-dimensional clothing.

2. The two-dimensional clothing of claim 1, wherein the depiction of the front side of the two-dimensional clothing is also on the second side of the piece of paper.

3. The two-dimensional clothing of claim 1, wherein the depiction of the back side of said the two-dimensional clothing is also on the second side of the piece of paper.

4. A kit comprising a two-dimensional doll and the two-dimensional clothing of claim 1, the two-dimensional doll defining shoulders being non-perpendicular to a neck of the two-dimensional doll, and the two-dimensional clothing adapted thereto.

5. The kit of claim 4, wherein the depiction of the front side of clothing and the depiction of the back side of two-dimensional clothing of the two-dimensional clothing are of equal size.

6. The kit of claim 4, further wherein the depiction of the front side of clothing and the depiction of the back side of the two-dimensional clothing have the same fashion style.

7. A device comprising:

a two-dimensional doll; and two-dimensional clothing comprising:

a first side of a piece of paper and a second side of the piece of paper;

on the first side of the piece of paper, a depiction of a front side of clothing and a depiction of a back side of clothing;

a fold line at a line of symmetry between the depiction of the front side and the depiction of the back side of the two-dimensional clothing;

at least one shoulder strap with a front side portion and a back side portion separated by the fold line;

a folded area formed on the at least one shoulder strap, the folded area formed by two additional folds that intersect at the fold line on a side adjacent a portal of the two-dimensional clothing and extend outwardly away from the fold line to an opposite side of the at least one shoulder strap;

wherein one of glue and tape is placed on the second side of the piece of paper, covering the fold line and the folded area such that the two additional folds of the folded area remains folded;

wherein the portal extends from said line of symmetry, away from said line of symmetry in either direction; and, wherein the two-dimensional clothing is adapted for placement on shoulders of said two-dimensional doll through use of the at least one shoulder strap extending from the front side of the two-dimensional clothing to the back side of the two-dimensional clothing.

* * * * *